US009808919B2

(12) United States Patent
Saur

(10) Patent No.: US 9,808,919 B2
(45) Date of Patent: Nov. 7, 2017

(54) HANDHELD SCREWING APPARATUS

(71) Applicant: Robert Bosch GmbH, Stuttgart (DE)

(72) Inventor: Dietmar Saur, Gomaringen (DE)

(73) Assignee: Robert Bosch GmbH, Stuttgart (DE)

( * ) Notice: Subject to any disclaimer, the term of this patent is extended or adjusted under 35 U.S.C. 154(b) by 7 days.

(21) Appl. No.: 13/909,217

(22) Filed: Jun. 4, 2013

(65) Prior Publication Data

US 2013/0331229 A1 Dec. 12, 2013

(30) Foreign Application Priority Data

Jun. 5, 2012 (DE) ..... 10 2012 209 447

(51) Int. Cl.
*B25B 23/147* (2006.01)
*B25B 23/14* (2006.01)

(52) U.S. Cl.
CPC ..... *B25B 23/147* (2013.01); *B25B 23/141* (2013.01); *Y10T 477/32* (2015.01)

(58) Field of Classification Search
None
See application file for complete search history.

(56) References Cited

U.S. PATENT DOCUMENTS

| | | | | |
|---|---|---|---|---|
| 4,787,136 | A * | 11/1988 | Majic | 29/709 |
| 5,692,789 | A | 12/1997 | Woodsum | |
| 5,697,269 | A | 12/1997 | Tseng | |
| 7,673,701 | B2 * | 3/2010 | Tanaka et al. | 173/4 |
| 2007/0095154 | A1 * | 5/2007 | Schuele | B25B 23/147 73/862.21 |
| 2007/0180959 | A1 * | 8/2007 | Tokunaga et al. | 81/474 |

FOREIGN PATENT DOCUMENTS

| | | | |
|---|---|---|---|
| CN | 2411084 | Y | 12/2000 |
| CN | 2411872 | Y | 12/2000 |
| DE | 10 2009 046 663 | | 7/2010 |

* cited by examiner

*Primary Examiner* — Mark Manley
(74) *Attorney, Agent, or Firm* — Norton Rose Fulbright US LLP; Gerard Messina

(57) ABSTRACT

A handheld screwing apparatus having a torque clutch provided to restrict a torque that is maximally able to be transmitted to an inserted tool. The handheld screwing apparatus includes at least one monitoring unit, which is set up to ascertain a characteristic rotational offset quantity that describes a rotational offset of the torque clutch.

6 Claims, 3 Drawing Sheets

HANDHELD SCREWING APPARATUS

RELATED APPLICATION INFORMATION

The present application claims priority to and the benefit of German patent application no. 10 2012 209 447.4, which was filed in Germany on Jun. 5, 2012, the disclosure of which is incorporated herein by reference.

FIELD OF THE INVENTION

The present invention relates to a handheld screwing apparatus having a torque clutch which is provided to restrict a torque that is maximally able to be transmitted to an inserted tool, and including at least one monitoring unit.

BACKGROUND INFORMATION

A handheld screwing apparatus equipped with a torque clutch for restricting a maximum torque that is able to be transmitted to an inserted tool is believed to be understood.

SUMMARY OF THE INVENTION

The present invention is based on a handheld screwing apparatus having a torque clutch for restricting a maximum torque that is able to be transmitted to an inserted tool.

It is proposed that the handheld screwing apparatus includes at least one monitoring unit, which is set up to ascertain a characteristic rotational offset quantity that describes a rotational offset of the torque clutch. A "torque clutch" in particular describes a mechanical clutch which interrupts a rotary connection between an inserted tool mounting mechanism that fixates the inserted tool, and a drive unit of the handheld screwing apparatus, when the maximally transmittable torque has been exceeded. The maximally transmittable torque may be adjustable by an operator. In an advantageous manner, the torque clutch is at least partially developed in one piece with a gearing of the handheld screwing apparatus. The mechanical torque clutch is realized as a torque clutch of the type considered useful by the expert, but which may be according to the development of the printed publication DE 10 2009 046 663 A1.

An "inserted tool" in particular describes an arrangement provided for the direct processing of a workpiece. In an advantageous manner, the inserted tool is meant to be driven in rotating manner during a working operation, in particular via the inserted tool mounting mechanism of the handheld screwing apparatus. The inserted tool in particular is developed as an inserted tool of the type considered useful by the expert, but advantageously as a screw bit, a screw socket, a drill, a keyhole saw and/or a milling tool. "Provided" in particular means specially programmed, designed and/or equipped. A "maximally transmittable torque" in particular describes a maximum torque generated by the drive unit, which the inserted tool mounting mechanism is able to exert on the inserted tool in a particular operating state, without the torque clutch opening. "Restrict" in this context in particular means that the torque clutch prevents the transmission of a torque that is higher than the maximum torque of the operating state.

A "monitoring unit" in particular describes a unit for recording the rotational offset and for outputting the characteristic rotational offset quantity in electrical form as a function of a value of the rotational offset. "Electric" arrangement digitally encoded and/or encoded in analog manner by a current, a charge and/or a voltage, in particular.

"Output in electrical form" in particular also means that the monitoring unit stores the characteristic rotational offset quantity in a memory used by multiple functions, in particular, and/or in a register of a computing unit. "Output" in particular means that the monitoring unit influences a current and/or voltage in a conductor and/or a memory for transmitting the characteristic rotational offset quantity. A "characteristic rotational offset quantity" in particular means a characteristic quantity containing information as a function of the rotational offset, which may assume more than two different values. The characteristic rotational offset quantity may be digitally encoded. As an alternative, the characteristic rotational offset quantity could be encoded in analog form.

In an especially advantageous manner, the characteristic rotational offset quantity describes the number of times in a working cycle that the rotational torque clutch has become disengaged due to overturning. As an alternative, the characteristic rotational offset quantity could describe a time that has elapsed since the disengagement. Thus, the characteristic rotational offset quantity is essentially linear in relation to the rotational offset. A "rotational offset" in particular means a rotary motion of a part of the torque clutch that is rotationally linked to the drive unit, in relation to a part of the torque clutch that is rotationally linked to the clamping clutch. The development of the handheld screwing apparatus according to the present invention advantageously allows a flexible response to a rotational offset of the torque clutch in a constructionally simple manner. In addition, the mechanical torque clutch makes it possible to achieve an especially precise adjustment of the maximum torque. A reproducible behavior of the torque clutch is achievable, in particular, which is especially advantageous in the case of screw-fitted connections implemented in series.

In one further development, the handheld screwing apparatus includes a drive unit and a control unit, which is provided to control the drive unit as a function of the characteristic rotational offset quantity of the monitoring unit; this makes it possible to obtain advantageous working results in a constructionally simple and comfortable manner. A "drive unit" in particular means a unit which supplies rotational power to drive the inserted tool during a working process. The drive unit may be provided to convert power that differs from rotational power, especially electric energy, into the rotational power. A "control unit" in particular describes a unit for controlling and/or regulating a rotational power, torque and/or an engine speed supplied by the drive unit. The control unit advantageously has a computing unit. A "computing unit" in particular means a unit having information input, information processing, and information output, in particular.

The computing unit advantageously includes at least one processor, a memory, input and output arrangement, additional electrical components, an operating program, regulation routines, control routines and/or calculation routines. The components of the computing unit may be situated on a shared circuit board and/or advantageously are disposed inside a shared housing. The control unit and the monitoring unit may at least partially, especially, essentially, be configured as separate entities. The control unit and the monitoring unit may include a shared computing unit, which executes computing routines of the control unit and the monitoring unit. "To control as a function of a characteristic rotational offset quantity of the monitoring unit" in particular means that the control unit uses at least the characteristic rotational offset quantity to determine a power, an engine speed and/or a torque to be output by the drive unit.

It is furthermore provided that the control unit reduces an engine speed of the drive unit as a function of the characteristic rotational offset quantity, so that an especially flexible use and low wear of the torque clutch are able to be achieved. "To reduce" in particular means that in one operating state, the control unit lowers the engine speed of the drive unit, i.e., from an engine speed predefined by the operator, to a lower engine speed. In one operating state, the control unit may lower the engine speed to a value other than zero and keeps it at this engine speed over a certain period of time, in particular.

In an advantageous manner, the control unit is provided to stop the drive unit as a function of the characteristic rotational offset quantity, i.e., to reduce the engine speed to zero, in one operating state. The control unit may be provided to decelerate the inserted tool mounting mechanism by the drive unit immediately prior to stopping the drive unit. The drive unit may decelerate the inserted tool mounting mechanism by at least reversing a polarity and/or short-circuiting the drive unit. As an alternative or optionally in addition, the control unit could decelerate the inserted tool mounting mechanism with the aid of a brake. In an especially advantageous manner, the control unit includes a threshold value which describes a maximum rotational offset of the torque clutch before the control unit reduces the engine speed of the drive unit.

Furthermore, the control unit is provided to control the drive unit as a function of the characteristic rotational offset quantity of the monitoring unit as well as an operator characteristic, so that an advantageous adaptation to different working situations is able to be realized. An "operator characteristic" in particular describes a characteristic quantity of an operating arrangement that depends on an operator input. The control unit may be provided to specify the maximum rotational offset as a function of the operator characteristic.

In addition, the dependency of the control of the drive unit upon the characteristic rotational offset quantity of the monitoring unit is able to be deactivated, which allows the handheld screwing apparatus to be used in the conventional manner. "Able to be deactivated" in particular means that in one operating state, the control unit controls and/or regulates the drive unit as a function of the characteristic rotational offset quantity.

It is furthermore proposed that the torque clutch includes at least one operating arrangement, which an operator may use to adjust the maximum torque transmittable to the inserted tool, so that the handheld screwing apparatus is able to be used in especially varied manner. An "operating arrangement" in particular describes an arrangement which outputs an actuating variable as a function of an operation by the operator, either electrically and/or mechanically, the latter being advantageous in this context. The maximum torque may be transmittable to the inserted tool is a function of the actuating variable.

In one advantageous development of the present invention, the monitoring unit includes a sensor which records at least one item of information of the characteristic rotational offset quantity at the torque clutch, so that the characteristic rotational offset quantity is able to be detected in reliable manner by simple design measures. A "sensor" is a unit for translating a measured state into a characteristic quantity, advantageously into an electric characteristic quantity. "At the torque clutch" in particular means that the sensor is at least partially situated less than 25 mm, advantageously less than 10 mm, especially advantageously, less than 5 mm, from at least one region of the torque clutch. For example, a response of the torque clutch could mechanically close a switch of the sensor, and/or the sensor could detect a motion of a part of the torque clutch in the response of the torque clutch, in capacitive and/or magnetic manner. As an alternative or in addition, a sensor could determine the response of the torque clutch from at least one characteristic quantity of an energy supply of the drive unit. "To record information" in particular means that the sensor is provided to supply a characteristic quantity, which may be an electric characteristic quantity, as a function of the response of the torque clutch, this information being used by the monitoring unit to ascertain the characteristic torque offset quantity.

In one further development, the sensor is provided to record a motion of a pressure arrangement of the torque clutch, which makes it possible to determine the torque offset characteristic in an especially wear-free and reliable manner. A "pressure arrangement" in particular describes an arrangement of the torque clutch which is pushed away from a locking body of the torque clutch in a response of the torque clutch, in order to open the torque clutch. The pressure arrangement may be configured as pressure disk which encloses an axis of rotation of the inserted tool mounting mechanism. A "motion of the pressure arrangement" in particular means a motion of the pressure arrangement in relation to a handheld tool housing occurring in the response of the torque clutch.

It is furthermore proposed that the sensor is developed as a switch, which makes it possible to keep the cost negligible. A "switch" in particular means a sensor which outputs a characteristic quantity having a switching flank as a function of an operation. The switch is advantageously developed as push-button switch. A movement of a part of the switch may close a mechanical contact. As an alternative or in addition, the switch could have a capacitive contact and/or an inductive contact, e.g., a reed relay.

Moreover, a drilling and/or screwing machine is provided, which have/has a handheld screwing apparatus according to the present invention. A "drilling and/or screwing machine" in particular means a machine for driving at least a drill, a screw bit, a screw nut and/or especially a chisel.

Further advantages are derived from the subsequent description of the drawing. The drawing shows an exemplary embodiment of the present invention. The drawing, the description and the claims contain numerous features in combination. One skilled in the art will expediently consider the features also individually, and will combine them into useful further combinations.

DETAILED DESCRIPTION

Figure 1:
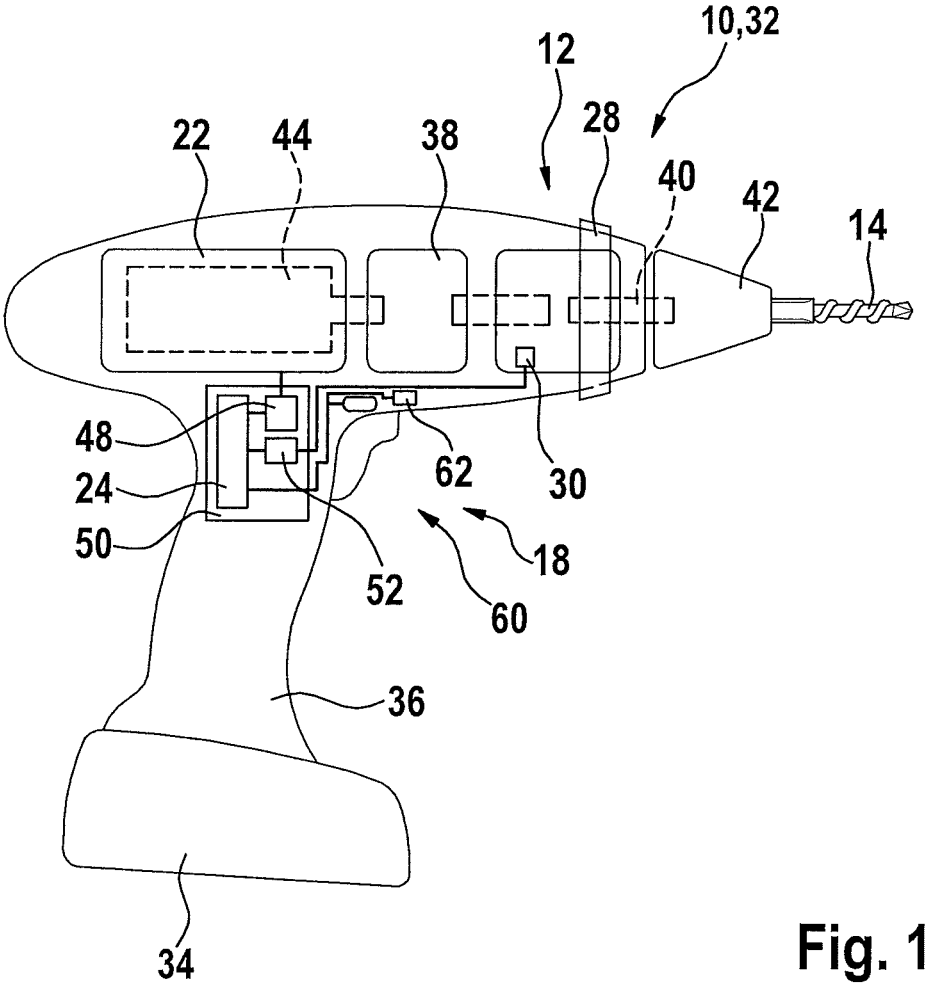
FIG. 1 shows a drilling and/or screwing machine having a handheld screwing apparatus according to the present invention.

FIG. 1 shows a drilling and/or screwing machine 32 and a handheld tool battery 34. Drilling and/or screwing machine 32 includes a handheld screwing apparatus 10 according to the present invention and a pistol-shaped handheld tool housing 36. Handheld tool battery 34 is connected to handheld tool housing 36 in such a way that an operator is able to detach it without using tools. Handheld tool battery 34 supplies electrical energy to handheld screwing apparatus 10 while it is operating. As an alternative, drilling and/or screwing machine 32 could be provided to withdraw energy directly from a power-supply system.

Figure 2:
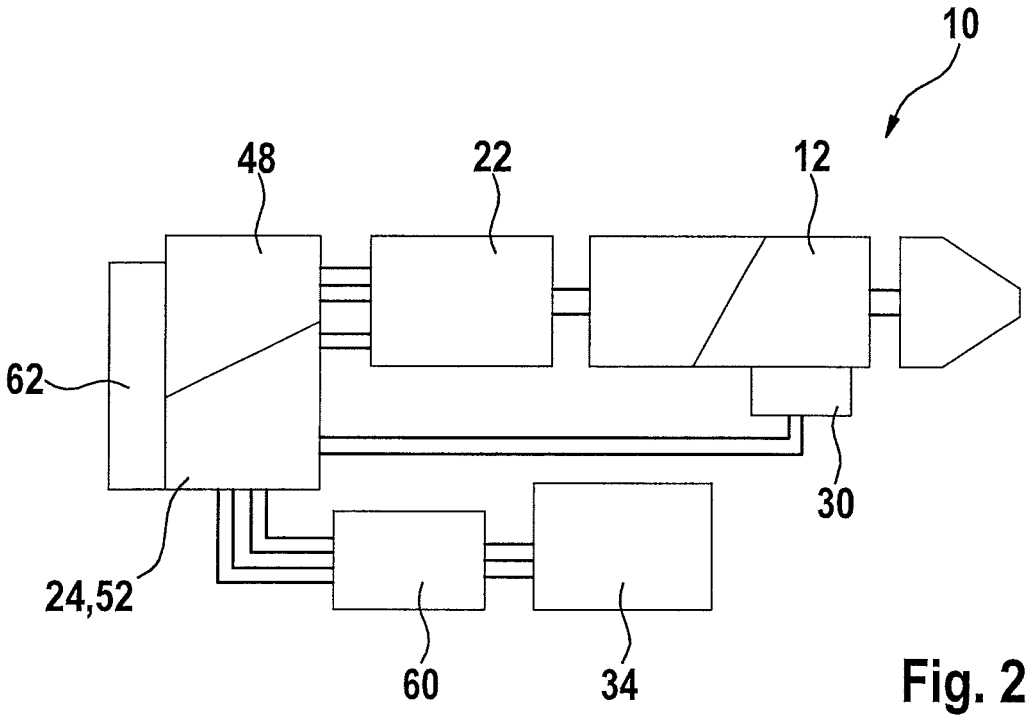
FIG. 2 shows a function chart of the handheld screwing apparatus from FIG. 1.
Figure 3:
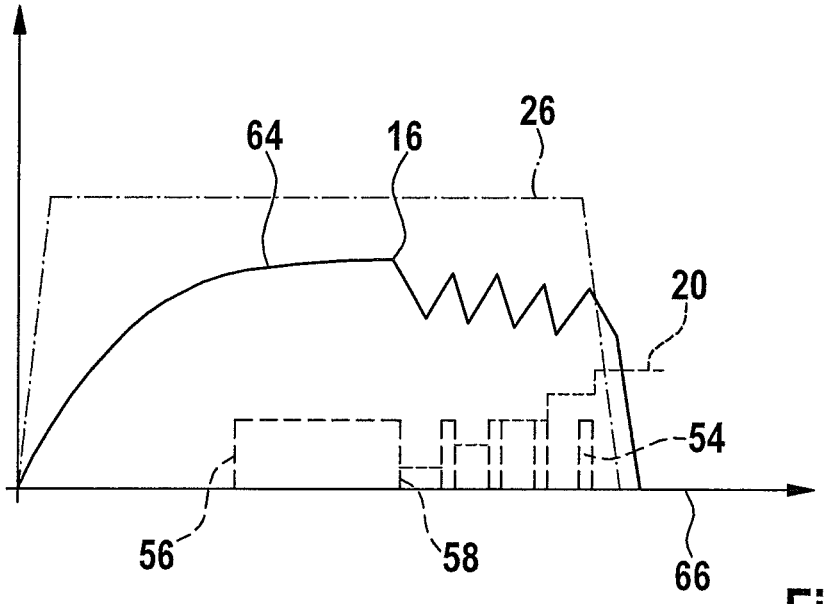
FIG. 3 shows a diagram of a torque.
Figure 4:
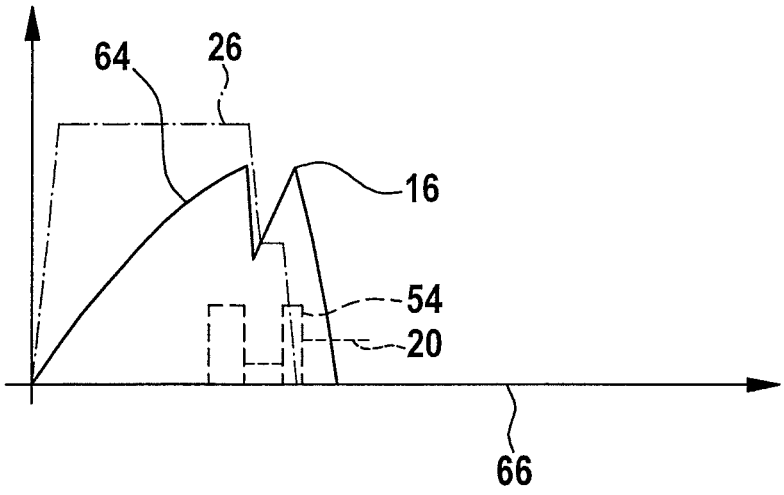
FIG. 4 shows a diagram of a rotational speed.
Figure 5:
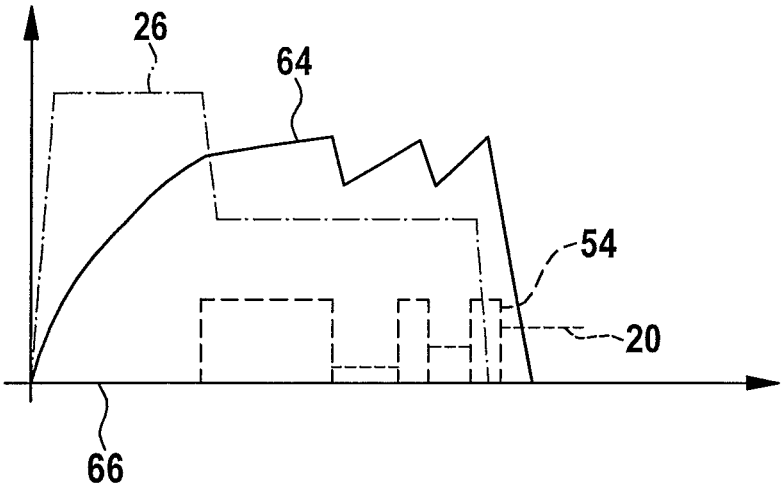
FIG. 5 shows a diagram of a characteristic quantity of a torque offset.
Figure 6:
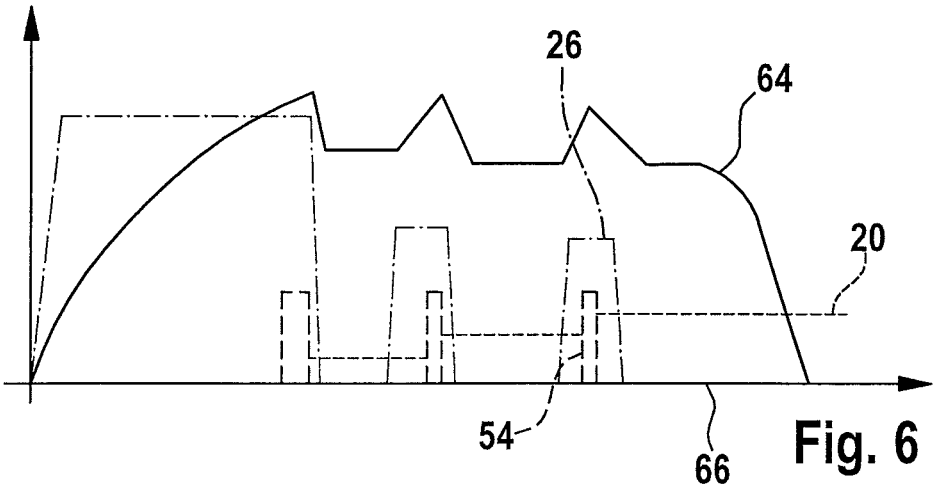
FIG. 6 shows a diagram of a characteristic quantity of a torque offset.

FIG. 2 shows handheld screwing apparatus 10, which includes a torque clutch 12, a monitoring unit 18, a drive unit 22, a control unit 24, a gearing 38, a tool spindle 40, and an inserted tool mounting mechanism 42. In an operational state, inserted tool mounting mechanism 42 fixates an inserted tool 14 in torsionally fixed manner. Tool spindle 40 mounts inserted tool mounting mechanism 42 inside handheld tool housing 36 in rotational manner.

Torque clutch 12 transmits a torque from drive unit 22 in the direction of inserted tool mounting mechanism 42. In the case at hand, torque clutch 12 is functionally situated between gearing 38 and tool spindle 40. As an alternative, a torque clutch could be situated at some other location between drive unit 22 and inserted tool mounting mechanism 42 that the expert considers useful. Gearing 38 reduces an engine speed of a rotor 44 of drive unit 22 to a rotational speed of tool spindle 40. Gearing 38 is provided to supply different translations that an operator is able to select.

Torque clutch 12 mechanically restricts a torque 16 that is maximally able to be transmitted to an inserted tool 14. For this purpose torque clutch 12 is developed in a way that is considered useful by the expert. Torque clutch 12 includes (without being shown here in greater detail) a pressure arrangement, locking bodies, at least one spring, and a counterpressure arrangement. The counterpressure arrangement is driven by drive unit 22. The locking bodies connect the counterpressure arrangement to the pressure arrangement in torsionally fixed manner, until the maximally transmittable torque 16 has been reached. In so doing, the locking bodies exert a force on the pressure arrangement as a function of a transmitted torque. The pressure arrangement is mounted in such a way that it is able to move in relation to the at least one spring. Once the maximally transmittable torque 16 has been reached, the force pushes the pressure arrangement until the locking bodies disengage due to overturning and the torsionally fixed connection between the pressure arrangement and the counterpressure arrangement is temporarily interrupted. An operator may use operating arrangement 28 of torque clutch 12 to vary the force exerted by the spring in order to adjust different maximum torques 16. Operating arrangement 28 of torque clutch 12 is developed as adjustment ring.

Drive unit 22 is realized as an electric motor. Handheld screwing apparatus 10 includes power electronics 48, which control unit 24 uses to control drive unit 22. Monitoring unit 18, control unit 24 and power electronics 48 at least partially situated on a shared circuit board 50 together with a computing unit. Monitoring unit 18 and control unit 24 are at least partially implemented in software and hardware.

Monitoring unit 18 is provided to ascertain a characteristic rotational offset quantity 20, which describes a rotational offset of torque clutch 12. Monitoring unit 18 includes a sensor 30 and a computing routine 52 for this purpose. Sensor 30 detects information of characteristic rotational offset quantity 20 at torque clutch 12; it includes a switch, which is operated by a movement of the pressure arrangement of torque clutch 12 prior to disengagement due to overturning. Sensor 30 outputs a characteristic locking quantity 54. Characteristic locking quantity 54 has a first switching flank 56, which describes at which point the pressure arrangement operates the switch. Characteristic locking quantity 54 has a second switching flank 58, which describes at which point torque clutch 12 becomes disengaged due to overturning. As an alternative or in addition, a characteristic locking quantity could be linearly dependent upon a position of the pressure arrangement.

Computing routine 52 determines characteristic rotational offset quantity 20. As an alternative, it is possible to use some other device considered useful by the expert to ascertain characteristic rotational offset quantity 20. Characteristic rotational offset quantity 20 describes the number of locking processes of torque clutch 12 during a work operation.

Control unit 24 controls drive unit 22 as a function of characteristic rotational offset quantity 20 of monitoring unit 18, a first characteristic operator quantity of a first operating arrangement 60 of handheld screwing apparatus 10, and a second characteristic operator quantity of a second operating arrangement 62 of handheld screwing apparatus 10. Using first operating arrangement 60, an operator is able to control a direction of rotation and a rotational speed of inserted tool mounting mechanism 42 prior to disengagement due to overturning.

Second operating arrangement 62 may be used by the operator to select various operating modes of control unit 24. Control unit 24 includes a configuration for each operating mode. In these different operating modes, in particular given the same operator input via first operating arrangement 60, control unit 24 actuates drive unit 22 as a function of the particular operating mode configurations. An operator is able to set up the configurations of the operating modes via a computer interface (not shown further here). As an alternative, configurations of the operating modes may also be stored in control unit 24 in non-variable form. For example, the operating modes may be configured so that control unit 24 automatically stops drive unit 22 after two, five, ten or fifteen responses of torque clutch 12, notwithstanding the fact that the operator keeps first operating arrangement 60 actuated.

FIGS. 3 through 6 schematically illustrate a particular characteristic rotational offset quantity 20, a characteristic locking quantity 54, a torque characteristic 64, and an engine speed 26 of one of the operating modes over time 66, such as during a screwing operation.

In a first operating mode, control unit 24 stops drive unit 22 if the characteristic rotational offset quantity 20 has reached a value that corresponds to an at least five-time disengagement of torque clutch 12 due to overturning. Control unit 24 blocks a renewed activation of drive unit 22 until the operator terminates the work process by letting go of first operating arrangement 60 provided to control the engine speed.

In a second operating mode, control unit 24 reduces an engine speed of drive unit 22 as soon as characteristic rotational offset quantity 20 exhibits a value that represents the first disengagement of torque clutch 12 due to overturning. Control unit 24 stops drive unit 22 if characteristic rotational offset quantity 20 has a value that indicates that torque clutch 12 has become disengaged at least twice due to overturning.

In a third operating mode, control unit 24 reduces an engine speed of drive unit 22 as a function of first switching flank 56 of sensor 30. As an alternative, control unit 24 could reduce an engine speed of drive unit 22, stop it, and/or reduce it as a function of some other characteristic quantity of torque clutch 12 that appears meaningful to the expert and which, for instance, is linear with respect to a tension of the spring of torque clutch 12 and/or a motion of the pressure arrangement of torque clutch 12. In so doing, control unit 24 restricts a current flowing through drive unit 22. Control unit 24 stops drive unit 22 if characteristic rotational offset quantity 20 exhibits a value that corresponds to at least three disengagements of torque clutch 12 due to overturning.

In a fourth operating mode, control unit 24 stops drive unit 22 as soon as characteristic rotational offset quantity 20 features a value that represents a first disengagement of torque clutch 12 due to overturning. Following a certain period of time, control unit 24 controls the engine speed of drive unit 22 to a predefined value that is greater than zero, in this case, one fourth of a maximally possible engine speed by way of example. Control unit 24 stops drive unit 22 as soon as characteristic rotational offset quantity 20 once again exhibits a value that represents a first disengagement of torque clutch 12 due to overturning.

In a fifth operating mode, which is not shown here in detail, control unit 24 controls drive unit 22 as a function of characteristic rotational offset quantity 20. It is therefore possible to deactivate a dependency of the control of drive unit 22 upon characteristic rotational offset quantity 20 of monitoring unit 18.

What is claimed is:

1. A handheld screwing apparatus, comprising:

a torque clutch configured to restrict a torque that is maximally able to be transmitted to an inserted tool, wherein the torque clutch has at least one manually adjustable operating element configured to adjust the torque that is maximally able to be transmitted to the inserted tool;

at least one monitoring unit configured to ascertain a characteristic rotational offset quantity which represents a number of times in a working cycle that the torque clutch has become disengaged due to overturning;

a drive unit; and a control unit configured to control the drive unit as a function of the characteristic rotational offset quantity of the monitoring unit and a characteristic operator quantity which represents a maximum value of the characteristic rotational offset quantity and depends on an operator input via an operating arrangement;

wherein the at least one monitoring unit includes a sensor which detects at least one item of information of the characteristic rotational offset quantity at the torque clutch, wherein the control unit stops the drive unit or reduces a motor speed of the drive unit when the characteristic rotational offset quantity reaches the characteristic operator quantity, wherein the control unit reduces the motor speed of the drive unit when the characteristic rotational offset quantity reaches a first predefined value and stops the drive unit when the characteristic rotational offset quantity reaches a second predefined value, the second predefined value being different from the first predefined value.

2. The handheld screwing apparatus of claim 1, wherein the dependency of the control of the drive unit upon the characteristic rotational offset quantity of the monitoring unit is able to be deactivated.

3. The handheld screwing apparatus of claim 1, wherein the sensor is configured to record a motion of a pressure arrangement of the torque clutch.

4. The handheld screwing apparatus of claim 1, wherein the sensor includes a switch.

5. A drilling and/or screwing machine, comprising:

a handheld screwing apparatus, including:

a torque clutch configured to restrict a torque that is maximally able to be transmitted to an inserted tool, wherein the torque clutch has at least one manually adjustable operating element configured to adjust the torque that is maximally able to be transmitted to the inserted tool;

at least one monitoring unit configured to ascertain a characteristic rotational offset quantity which represents a number of times in a working cycle that the torque clutch has become disengaged due to overturning;

a drive unit; and a control unit configured to control the drive unit as a function of the characteristic rotational offset quantity of the monitoring unit and a characteristic operator quantity which represents a maximum value of the characteristic rotational offset quantity and depends on an operator input via an operating arrangement, wherein the at least one monitoring unit includes a sensor which detects at least one item of information of the characteristic rotational offset quantity at the torque clutch, wherein the control unit stops the drive unit or reduces a motor speed of the drive unit when the characteristic rotational offset quantity reaches the characteristic operator quantity, wherein the control unit reduces the motor speed of the drive unit when the characteristic rotational offset quantity reaches a first predefined value and stops the drive unit when the characteristic rotational offset quantity reaches a second predefined value, the second predefined value being different from the first predefined value.

6. A handheld screwing apparatus, comprising:

a torque clutch configured to restrict a torque that is maximally able to be transmitted to an inserted tool, wherein the torque clutch has at least one manually adjustable operating element configured to adjust the torque that is maximally able to be transmitted to the inserted tool;

at least one monitoring unit configured to ascertain a characteristic rotational offset quantity which represents a number of times in a working cycle that the torque clutch has become disengaged due to overturning;

a drive unit; and a control unit configured to control the drive unit as a function of the characteristic rotational offset quantity of the monitoring unit;

wherein the at least one monitoring unit includes a sensor which detects at least one item of information of the characteristic rotational offset quantity at the torque clutch, wherein the control unit stops the drive unit or reduces a motor speed of the drive unit when the characteristic rotational offset quantity reaches a predefined value, wherein the control unit reduces the motor speed of the drive unit when the characteristic rotational offset quantity reaches a first predefined value and stops the drive unit when the characteristic rotational offset quantity reaches a second predefined value, the second predefined value being different from the first predefined value.

* * * * *